US008711081B2

(12) United States Patent
Yang et al.

(10) Patent No.: US 8,711,081 B2
(45) Date of Patent: Apr. 29, 2014

(54) DRIVING APPARATUS HAVING AN OPTICAL SENSOR AND A THERMAL SENSOR FOR THERMAL AND AGING COMPENSATION OF BACKLIGHT MODULE AND DRIVING METHOD OF BACKLIGHT MODULE

(75) Inventors: Chiao-Chih Yang, Hsin-Chu (TW); Chih-Hua Lin, Hsin-Chu (TW); Wei-Jen Chou, Hsin-Chu (TW); Chien-Chung Hsiao, Hsin-Chu (TW)

(73) Assignee: Young Lighting Technology Inc., Hsin-chu (TW)

( * ) Notice: Subject to any disclaimer, the term of this patent is extended or adjusted under 35 U.S.C. 154(b) by 361 days.

(21) Appl. No.: 12/754,612

(22) Filed: Apr. 6, 2010

(65) Prior Publication Data

US 2010/0259572 A1 Oct. 14, 2010

(30) Foreign Application Priority Data

Apr. 8, 2009 (TW) ..... 98111735 A

(51) Int. Cl.
*G09G 3/36* (2006.01)

(52) U.S. Cl.
USPC ..... 345/102; 345/697

(58) Field of Classification Search
USPC ..... 345/102
See application file for complete search history.

(56) References Cited

U.S. PATENT DOCUMENTS

| | | | | |
|---|---|---|---|---|
| 6,841,947 | B2 | 1/2005 | Berg-Johansen | |
| 7,404,645 | B2 | 7/2008 | Margulis | |
| 2003/0214242 | A1 | 11/2003 | Berg-Johansen | |
| 2006/0221047 | A1 * | 10/2006 | Tanizoe et al. | 345/102 |
| 2008/0074382 | A1 * | 3/2008 | Lee et al. | 345/102 |
| 2008/0136770 | A1 * | 6/2008 | Peker et al. | 345/102 |
| 2008/0180414 | A1 | 7/2008 | Fung et al. | |
| 2008/0245949 | A1 * | 10/2008 | Morimoto et al. | 250/205 |

FOREIGN PATENT DOCUMENTS

| | | |
|---|---|---|
| TW | 200719304 | 5/2007 |
| TW | 200727255 | 7/2007 |
| TW | 200814852 | 3/2008 |
| TW | 200903080 A | 1/2009 |
| TW | 200912837 A | 3/2009 |
| TW | 200915288 A | 4/2009 |

* cited by examiner

*Primary Examiner* — Long D Pham
(74) *Attorney, Agent, or Firm* — Chun-Ming Shih

(57) ABSTRACT

A driving apparatus and a driving method of a backlight module are provided. The backlight module includes multiple LEDs. The driving apparatus includes at least one thermal sensor, an optical sensor, and a processor. The thermal sensor is for detecting a working temperature of the LEDs. The optical sensor is for detecting brightness and color of the backlight module after a calibration function is enabled, to obtain difference values of the detected brightness and color with respect to predetermined brightness and color. The processor is for providing at least one initial thermal compensation table, to determine working currents of the LEDs associated with the working temperature. The processor further is for calibrating a content of the initial thermal compensation table corresponding with a current working temperature of the LEDs and storing the calibrated thermal compensation table as the initial thermal compensation table after the calibration function is enabled.

20 Claims, 6 Drawing Sheets

DRIVING APPARATUS HAVING AN OPTICAL SENSOR AND A THERMAL SENSOR FOR THERMAL AND AGING COMPENSATION OF BACKLIGHT MODULE AND DRIVING METHOD OF BACKLIGHT MODULE

CROSS-REFERENCE TO RELATED APPLICATIONS

This application is based upon and claims the benefit of priority from the prior Taiwanese Patent Application No. 098111735, filed Apr. 8, 2009, the entire contents of which are incorporated herein by reference.

BACKGROUND

1. Technical Field

The invention generally relates to driving apparatuses and driving methods of display devices, and more particularly to a driving apparatus and a driving method of a backlight module.

2. Description of the Related Art

In regard to a non-emissive display device such as a liquid crystal display, a backlight module is a main light source of the non-emissive display device. The luminescence characteristic and life-span of the light source generally have inclose relationship with the display quality and life-span of an end product. In order to meet the increasing demands for environmental protection, energy saving, colors as well as images, light emitting diodes have been widely used as such light source.

Nowadays, the backlight module primarily have two operation modes. One of the operation modes is that a plurality of light emitting diodes of the backlight module always keep at on-state, and the other one of the operation modes is that a plurality of light emitting diodes of the backlight module use local dimming technology and thus bright and dark levels of the light emitting diodes in each local area would vary along with the change of panel display signals among bright level, dark level, and gray levels.

When the backlight module is in operation, energy received by the light emitting diodes of the backlight module would be converted into heat except a part thereof being converted into emission light. Since the luminescence characteristic of the light emitting diodes is highly sensitive to temperature, rise in temperature associated with the light emitting diodes would result in brightness decay and emission wavelength shift; and moreover the light emitting diodes would occur the phenomenon of brightness and color decay resulting from aging caused by the use of long-time. As a result, brightness and color of the backlight module in operation would be decayed. Accordingly, how to compensate the brightness and color decay caused by rise in temperature and/or aging of the light emitting diodes, so as to maintain the brightness and color of the backlight module is an issue required to be urgently solved.

BRIEF SUMMARY

The invention provides a driving apparatus of a backlight module, for compensating the decay of brightness and/or color of the backlight module caused by rise in temperature and/or aging associated with light emitting diodes.

The invention further provides a driving method of a backlight module, for compensating the decay of brightness and/or color of the backlight module caused by rise in temperature and/or aging associated with light emitting diodes.

In order to achieve one or part of or all the objectives, or to achieve other objectives, a driving apparatus of a backlight module in accordance with an embodiment of the invention is provided. The driving apparatus is adapted to a display device. The display device includes a display panel and the backlight module for providing backlighting illumination to the display panel. The backlight module includes a plurality of light emitting diodes. The driving apparatus includes at least one thermal sensor, an optical sensor, and a processor. The at least one thermal sensor is for detecting a working temperature of the light emitting diodes. The optical sensor is for detecting brightness and color of the backlight module after a calibration function is enabled, so as to obtain difference values of the detected brightness and color with respect to predetermined brightness and color. The processor is for providing at least one initial thermal compensation table, so as to determine working currents of the light emitting diodes associated with the working temperature. After the calibration function is enabled, the processor is further for calibrating a content of the at least one initial thermal compensation table corresponding with a current working temperature of the light emitting diodes according to the difference values and storing the calibrated thermal compensation table as the at least one initial thermal compensation table. Wherein, the current working temperature is the working temperature detected by the at least one thermal sensor when the optical sensor is detecting the brightness and color of the backlight module.

In order to achieve one or part of or all of the objectives, or to achieve other objectives, a driving method of a backlight module in accordance with another embodiment of the invention is provided. The driving method is adapted to a display device. The display device includes a display panel and the backlight module for providing backlighting illumination to the display panel. The backlight module includes a plurality of areas, and each of the areas has a plurality of light emitting diodes arranged therein. The driving method includes the following steps: detecting a working temperature of the light emitting diodes of each of the areas; providing a plurality of initial thermal compensation tables, so as to respectively compensate brightnesses and colors of the areas associated with respective the working temperatures; detecting brightness and color of the backlight module after a calibration function is enabled, so as to obtain difference values of the detected brightness and color with respect to predetermined brightness and color; and calibrating a content of each of the initial thermal compensation tables corresponding with a current working temperature of the light emitting diodes of each of the areas according to the difference values and storing the calibrated thermal compensation tables as the initial thermal compensation tables.

In order to achieve one or part of or all of the objectives, or to achieve other objectives, a driving method of a backlight module in accordance with still another embodiment of the invention is provided. The driving method is adapted to a display device. The display device includes a display panel and the backlight module for providing backlighting illumination to the display panel. The backlight module includes a plurality of light emitting diodes. The driving method includes the following steps: detecting a working temperature of the light emitting diodes; providing an initial thermal compensation table, so as to compensate brightness and color of the backlight module associated with the working temperature; detecting brightness and color of the backlight module after a calibration function is enabled, so as to obtain difference values of the detected brightness and color with respect to predetermined brightness and color; and calibrating a content of the initial thermal compensation table corresponding with a current working temperature of the light emitting diodes according to the difference values and storing the calibrated thermal compensation table as the initial thermal compensation table.

With regard to the above-mentioned embodiments of the invention, in one aspect, by compensating brightness and color decay of a plurality of light emitting diodes caused by rise in temperature according to the initial thermal compensation table(s), to feedback control the brightness and color decay of the backlight module; in another aspect, by calibrating the content(s) of the initial thermal compensation table(s), to compensate the brightness and color decay caused by aging of the light emitting diodes. Accordingly, the driving apparatus and driving methods in accordance with the above-mentioned embodiments may achieve better compensation effects, and thus the brightness and color of the backlight module may be maintained.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute part of this specification. The drawings illustrate embodiments of the invention and, together with the description, serve to explain the principles of the invention.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "rear," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted" and variations thereof herein are used broadly and encompass direct and indirect connections, couplings, and mountings. Similarly, the terms "facing," "faces" and variations thereof herein are used broadly and encompass direct and indirect facing, and "adjacent to" and variations thereof herein are used broadly and encompass directly and indirectly "adjacent to". Therefore, the description of "A" component facing "B" component herein may contain the situations that "A" component directly faces "B" component or one or more additional components are between "A" component and "B" component. Also, the description of "A" component "adjacent to" "B" component herein may contain the situations that "A" component is directly "adjacent to" "B" component or one or more additional components are between "A" component and "B" component. Accordingly, the drawings and descriptions will be regarded as illustrative in nature and not as restrictive.

Figure 1:
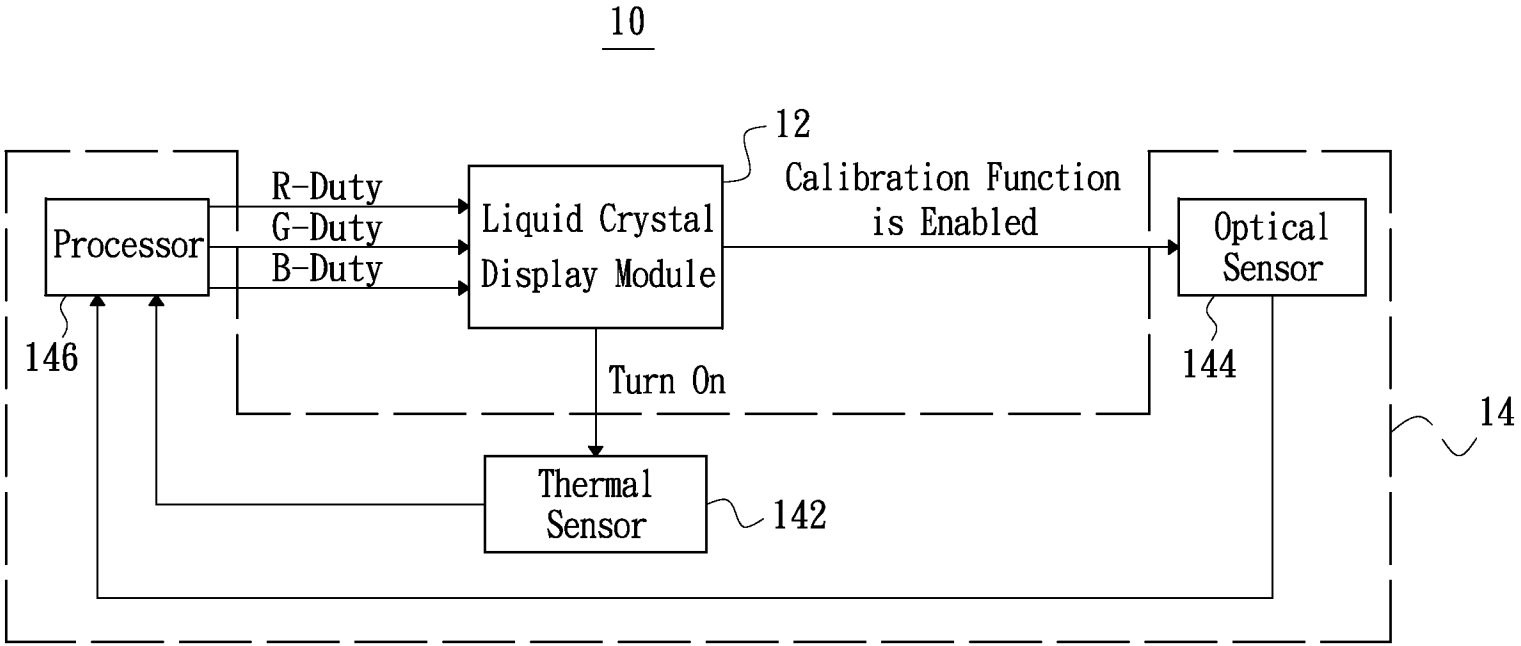
FIG. 1 is a schematic structural diagram of a liquid crystal display device in accordance with an embodiment of the invention.
Figure 2:
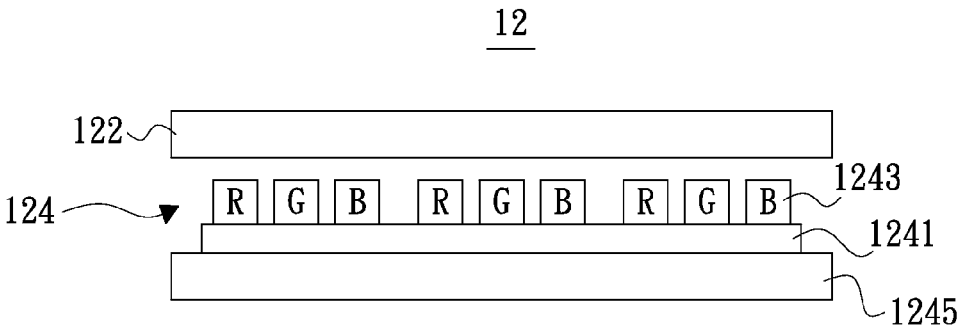
FIG. 2 is a schematic structure view of a liquid crystal display module in FIG. 1.
Figure 3:
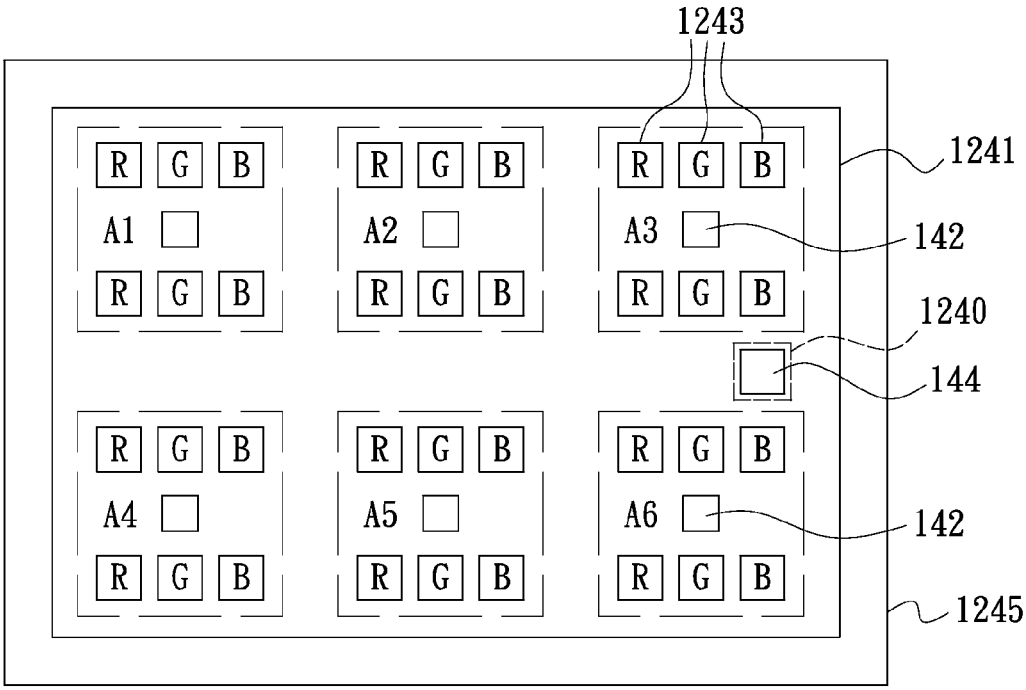
FIG. 3 shows multiple thermal sensors and an optical sensor associated with FIG. 1 respectively being arranged on a lamp board and a metal backplane.

Referring to FIGS. 1 through 3, a driving apparatus 14 of a backlight module in accordance with an embodiment of the invention is provided. The driving apparatus 14 is adapted to a display device such as a liquid crystal display device 10 using local dimming technology.

As illustrated in FIG. 1, the liquid crystal display device 10 includes a liquid crystal display module 12 and the driving apparatus 14 of the backlight module. The driving apparatus 14 includes at least one thermal sensor 142, an optical sensor 144, and a processor 146. The at least one thermal sensor 142 and the optical sensor 144 are electrically coupled to the processor 146.

As illustrated in FIG. 2, the liquid crystal display module 12 includes a liquid crystal display panel 122 and the backlight module 124 for providing backlighting illumination to the liquid crystal display panel 122. The backlight module 124 includes a lamp board 1241, a plurality of different colored light emitting diodes 1243 e.g., red, green, and blue tri-color light emitting diodes, and a metal backplane 1245. The light emitting diodes 1243 are arranged on the lamp board 1241 and at the front side of the lamp board 1241. The metal backplane 1245 is disposed at the rear side of the lamp board 1241.

Figure 4:
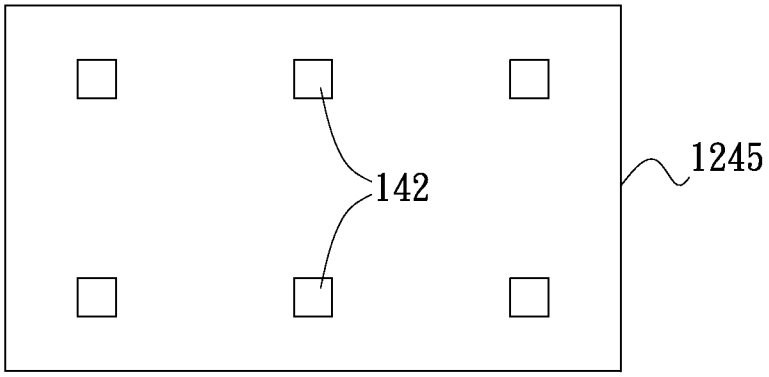
FIG. 4 shows multiple thermal sensors associated with FIG. 1 being arranged on a metal backplane.
Figure 5:
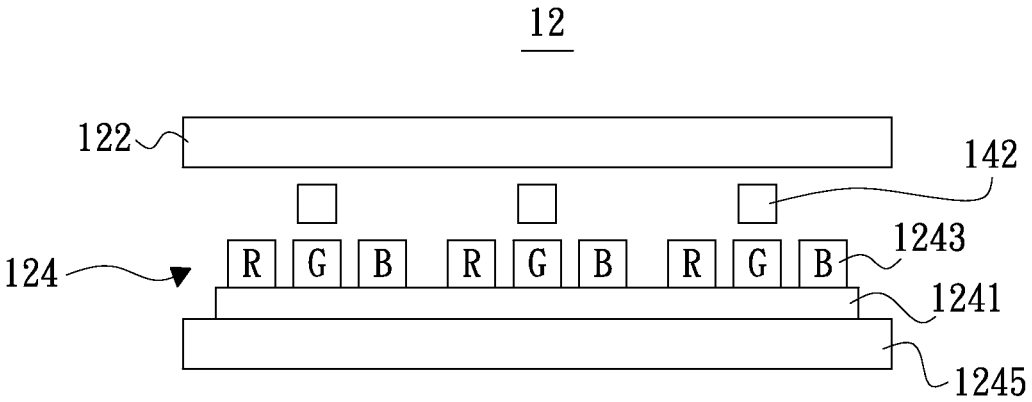
FIG. 5 shows multiple thermal sensors associated with FIG. 1 being arranged between a liquid crystal display panel and a backlight module.

As illustrated in FIG. 3, the amount of the at least one thermal sensor 142 is multiple. The multiple thermal sensors 142 are arranged on the lamp board 1241. The amount of the optical sensor 144 is one. The optical sensor 144 is arranged on the metal backplane 1245, and a location of the lamp board 1241 corresponding with the optical sensor 144 has an opening 1240 to expose the optical sensor 144. It is understood that the multiple thermal sensors 142 are not limited to be arranged on the lamp board 1241, and may be arranged on the metal backplane 1245 as illustrated in FIG. 4 or arranged between the liquid crystal display panel 122 and the backlight module 124 as illustrated in FIG. 5 instead.

Still referring to FIGS. 2 and 3, the backlight module 124 includes a plurality of areas A1~A6 defined thereon. Each of the areas A1~A6 has a plurality of red, green, and blue tri-color light emitting diodes 1243 arranged therein. Since the areas A1~A6 are electricity-independent from one another, bright and dark levels of the different colored light emitting diodes 1243 in the areas A1~A6 may vary along with the change of panel display signals among bright level, dark level, and gray levels, so that display image contrast and the number of gray level of the liquid crystal display device 10 may be increased and image blurs may be decreased. In the illustrated embodiment, each of the multiple thermal sensors 142 is arranged in one of the electricity-independent areas A1~A6, so as to detect a working temperature of the different colored light emitting diodes 1243 in each of the areas A1~A6. The working temperature is an ambient temperature formed by heat generated from the different colored light emitting diodes 1243.

A driving method implemented on the driving apparatus 14 of the backlight module 124 will be described below in detail with reference to FIGS. 1 and 6. The driving method includes the following steps.

The multiple thermal sensors 142 respectively detect working temperatures of the different colored light emitting diodes 1243 in respective areas A1~A6. The detected working temperatures of the areas A1~A6 respectively are ambient temperatures formed by heat generated from the different colored light emitting diodes 1243 in respective areas A1~A6.

A plurality of initial thermal compensation tables are provided, so as to respectively compensate brightnesses and colors of the areas A1~A6 associated with respective the working temperatures. The initial thermal compensation tables are provided in the processor 146 and the amount of the initial thermal compensation tables are identical with the amount of the multiple thermal sensors 142.

Figure 6:
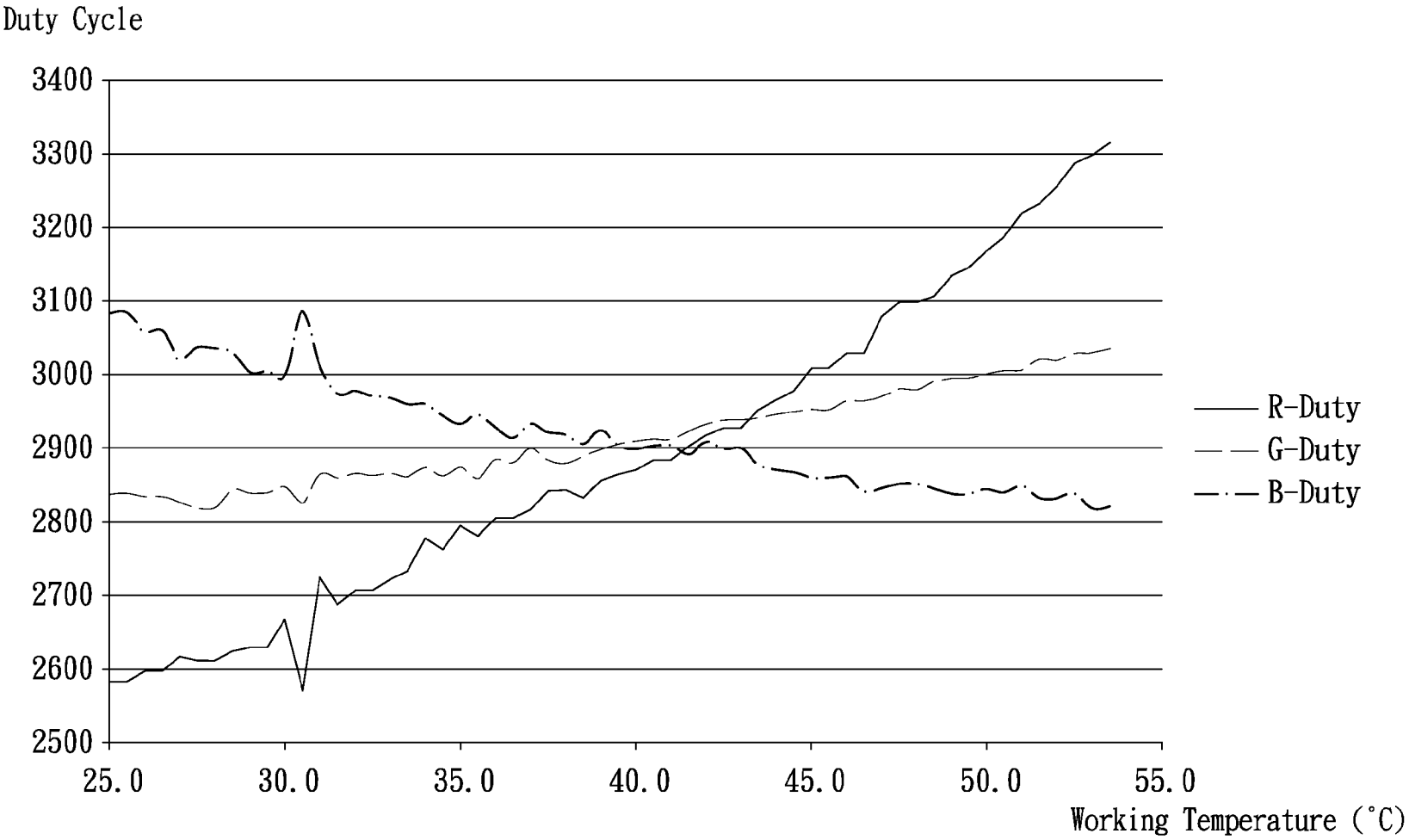
FIG. 6 shows a chart corresponding with an initial thermal compensation table, in accordance with an embodiment of the invention.

FIG. 6 shows a chart corresponding with an initial thermal compensation table for the purpose of illustration. As seen from FIG. 6, the content of the initial thermal compensation table includes work temperatures and duty cycles of driving pulses for the different colored light emitting diodes associated with respective the work temperatures. For the circumstance of red, green, and blue tri-color light emitting diodes being used, the initial thermal compensation table includes duty cycles (i.e., R-duty) of driving pulses for red light emitting diodes associated with respective working temperatures, duty cycles (i.e., G-duty) of driving pulses for green light emitting diodes associated with respective the working temperatures, and duty cycles (i.e., B-duty) of driving pulses for blue light emitting diodes associated with respective the working temperatures. Therefore, after the processor 146 obtains the work temperatures of the areas A1~A6 from the respective thermal sensors 142, the processor 146 determines working currents of the red, green, and blue tri-color light emitting diodes 1243 of each of the areas A1~A6 according to corresponding one of the initial thermal compensation tables and inputs the determined working currents to the liquid crystal display module 12, so as to accurately compensate the decay of brightness and/or color of the areas A1~A6 caused by rise in temperature associated with the light emitting diodes 1243. In the illustrated embodiment, the working currents of the light emitting diodes 1243 are embodied by the duty cycles of driving pulses.

After a calibration function is enabled, the optical sensor 144 detects brightness and color of the backlight module 124 and the multiple thermal sensors 142 detect current working temperatures of the different colored light emitting diodes of the areas A1~A6, so as to obtain difference values of the detected brightness and color with respect to predetermined brightness and color. In the illustrated embodiment, after the calibration function is enabled, all the different colored light emitting diodes 1243 in each of the areas A1~A6 of the backlight module 124 are fully on. The calibration function may be enabled before turning off the liquid crystal display device 10, or timing enabled.

A content of each of the initial thermal compensation tables corresponding with the current working temperature of the different colored light emitting diodes of each of the areas A1~A6 is calibrated according to the difference values of brightness and color, and then the calibrated thermal compensation tables are stored as the initial thermal compensation tables. Since the calibrated initial thermal compensation tables have taken the decay of brightness and/or color caused by aging of the light emitting diodes 1243 of respective the areas A1~A6 as consideration, effects produced by brightness and color compensation performed according to the calibrated initial thermal compensation tables would not be significantly degraded along with the light emitting diodes 1243 being used for long-time use and aged, and therefore the brightness and color of the backlight module 124 may maintain at a range with relatively small variation.

Figure 7:
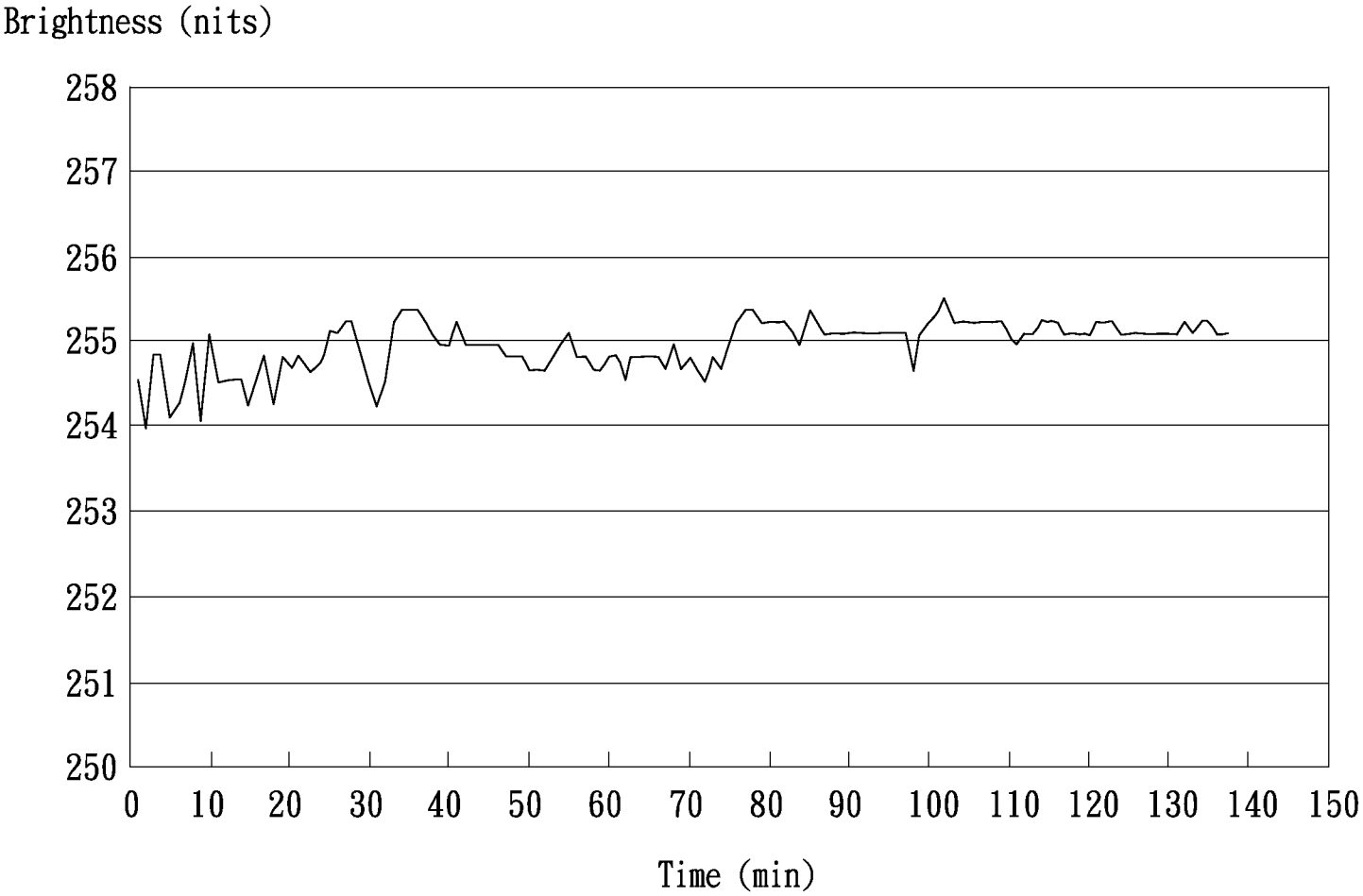
FIG. 7 shows a curve of brightness vs. time of a backlight module in accordance with an embodiment of the invention.
Figure 8:
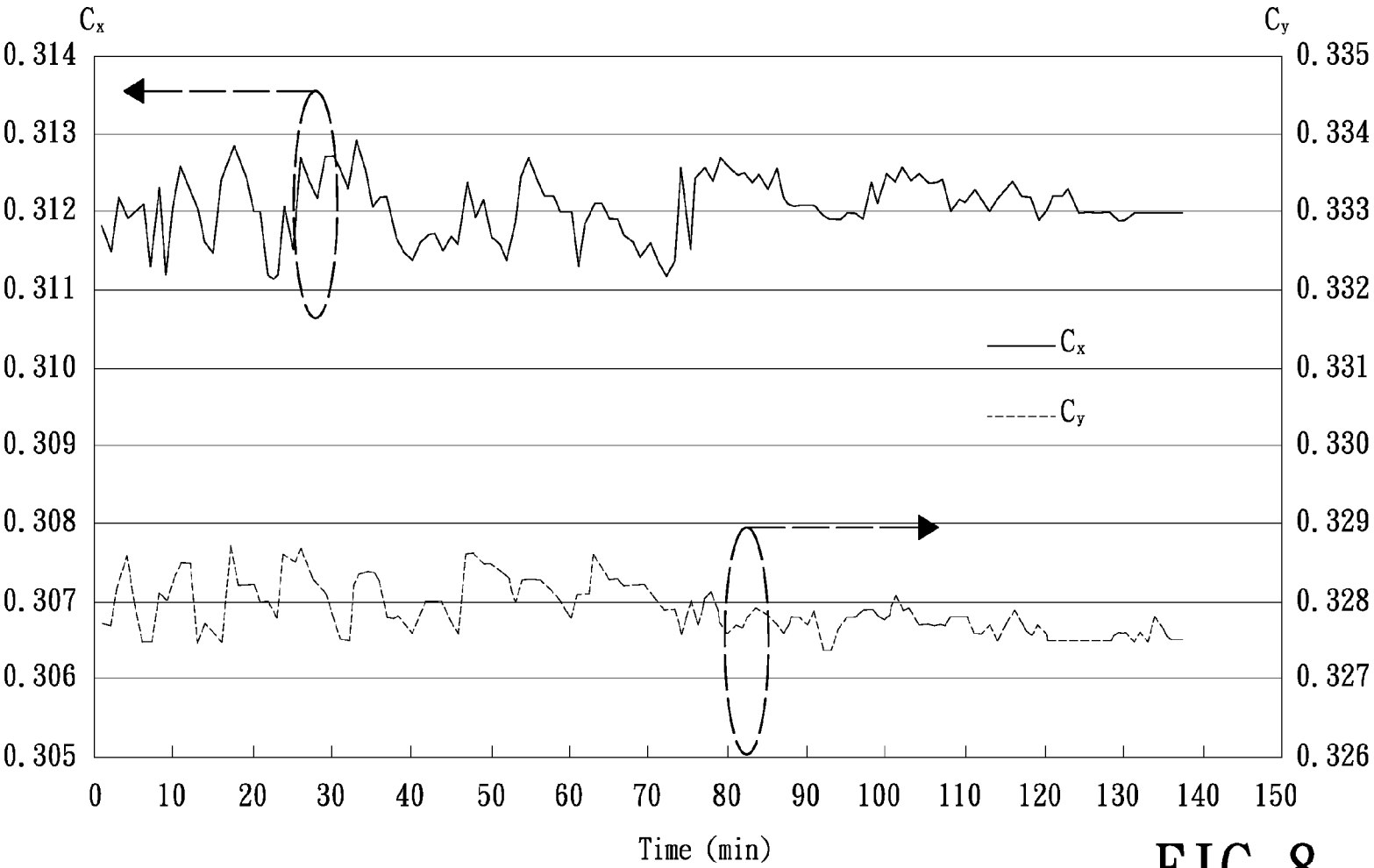
FIG. 8 shows a curve of color vs. time of a backlight module in accordance with an embodiment of the invention.

FIG. 7 shows a curve of brightness vs. time of the backlight module after the driving method in accordance with the embodiment of the invention, and FIG. 8 shows a curve of color vs. time of the backlight module after the driving method in accordance with the embodiment of the invention. More specifically, an initial brightness of the backlight module is 254.5 nits, an initial color's chromaticity coordinates Cx=0.312 and Cy=0.328. As seen from FIGS. 7 and 8, both the brightness variation and the color variation are ±1%. In other words, the uniformities of brightness and color both may be up to 98%.

It is indicated that, the above-mentioned embodiments of the invention are not limited to each of the electricity-independent areas A1~A6 has one thermal sensor 142 arranged therein, and may be, for example, taking the areas A1~A3 as one area and arranging one thermal sensor 142 therein, and taking the areas A4~A6 as another one area and arranging one thermal sensor 142 therein instead, or other similar manners. In other words, a plurality of thermal sensors 142 is disposed on the backlight module 124, and each area having the thermal sensor 142 includes at least one electricity-independent area.

In another embodiment, the backlight module 124 may only have one thermal sensor 142 arranged therein instead, and a temperature detected by the thermal sensor 142 will be taken as a working temperature of the different colored light emitting diodes of all the electricity-independent areas A1~A6. Correspondingly, the processor 146 only is needed to provide one initial thermal compensation table.

Additionally, the driving apparatus and driving method in accordance with the embodiments of the invention are not limited to applying to the liquid crystal display device using local dimming technology, and may be other type liquid crystal display device without using local dimming technology or other non-emissive display device equipped with backlight module.

Moreover, the backlight module in accordance with the embodiment of the invention is not limited to include a plurality of different colored light emitting diodes, and may use a plurality of same colored light emitting diodes e.g., white color light emitting diodes instead.

In summary, the embodiment or the embodiments of the invention may have at least one of the following advantages, with regard to the illustrated embodiments of the invention, in one aspect, by compensating the decay of brightness and color of a plurality of light emitting diodes caused by rise in temperature according to the initial thermal compensation table(s), to feedback control the decay of brightness and color of the backlight module; in another aspect, by calibrating the content(s) in the initial thermal compensation table(s), to compensate the decay of brightness and color caused by aging of the light emitting diodes; therefore the driving apparatus and driving method of the backlight module in accordance with the embodiments of the invention may achieve better compensation effects, and the brightness and color of the backlight module always may be maintained. Furthermore, by using a plurality of thermal sensors to perform multi-area feedback controls, the phenomenon of non-uniform brightness and color resulting from uneven heat in the multiple areas may be improved.

The foregoing description of the preferred embodiment of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like is not necessary limited the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A driving apparatus of a backlight module, adapted to a display device, the display device comprising a display panel and the backlight module for providing backlighting illumination to the display panel, the backlight module comprising a plurality of light emitting diodes, the driving apparatus comprising:

at least one thermal sensor for only detecting a working temperature of the light emitting diodes, the working temperature being a temperature formed by heat generated from the light emitting diodes;

an optical sensor for detecting brightness and color of the backlight module after a calibration function is enabled, so as to obtain difference values of the detected brightness and color with respect to predetermined brightness and color; and a processor provided with at least one initial thermal compensation table, wherein the processor is suitable for obtaining the working temperature and determining working currents of the light emitting diodes corresponding to the working temperature of the light emitting diodes according to the at least one initial thermal compensation table, and after the calibration function being enabled, the processor further for calibrating a content of the at least one initial thermal compensation table corresponding with a current working temperature of the light emitting diodes according to the difference values and storing the calibrated thermal compensation table as the at least one initial thermal compensation table, as a result of aging compensation of the light emitting diodes, wherein the current working temperature is the working temperature detected by the at least one thermal sensor when the optical sensor is detecting the brightness and color of the backlight module;

wherein the backlight module further comprises a lamp board and a metal backplane, the light emitting diodes are arranged on the lamp board and at the front side of the lamp board, the metal backplane is disposed at the rear side of the lamp board, the optical sensor is mounted to the metal backplane rather than the lamp board, and the lamp board is formed with an opening to expose the optical sensor.

2. The driving apparatus as claimed in claim 1, wherein the at least one thermal sensor is arranged on the lamp board.

3. The driving apparatus as claimed in claim 1, wherein the at least one thermal sensor is arranged on the metal backplane.

4. The driving apparatus as claimed in claim 1, wherein the at least one thermal sensor is arranged between the display panel and the backlight module.

5. The driving apparatus as claimed in claim 1, wherein the amount of the at least one thermal sensor is multiple, the backlight module comprises a plurality of areas and each of the areas has the light emitting diodes arranged therein, the multiple thermal sensors are respectively arranged in the areas.

6. The driving apparatus as claimed in claim 5, wherein each of the areas comprises at least one electricity-independent sub-area.

7. The driving apparatus as claimed in claim 1, wherein the working currents are embodied by duty cycles of driving pulses.

8. The driving apparatus as claimed in claim 1, wherein after the calibration function is enabled, the light emitting diodes are fully on.

9. The driving apparatus as claimed in claim 1, wherein the calibration function is enabled before turning off the display device.

10. The driving apparatus as claimed in claim 1, wherein the calibration function is timing enabled.

11. A driving method of a backlight module, adapted to a display device, the display device comprising a display panel and the backlight module for providing backlighting illumination to the display panel, the backlight module comprising a plurality of areas and each of the areas having a plurality of light emitting diodes arranged therein, and further the backlight module comprising a lamp board and a metal backplane, the light emitting diodes being arranged on the lamp board and at the front side of the lamp board, the metal backplane being disposed at the rear side of the lamp board, the optical sensor being arranged in contact with the metal backplane rather than the lamp board, and the lamp board being formed with an opening to expose the optical sensor, the driving method comprising:

only detecting a working temperature of the light emitting diodes of each of the areas, the working temperature being a temperature formed by heat generated from the light emitting diodes;

providing a plurality of initial thermal compensation tables, obtaining the working temperature and determining working currents of the light emitting diodes of each of the areas corresponding to the working temperature of the light emitting diodes for compensating brightnesses and colors of the areas due to changes of the working temperatures according to the plurality of initial thermal compensation tables respectively;

detecting brightness and color of the backlight module at the opening by the optical sensor after a calibration function is enabled, so as to obtain difference values of the detected brightness and color with respect to predetermined brightness and color; and calibrating a content of each of the initial thermal compensation tables corresponding with a current working temperature of the light emitting diodes of each of the areas according to the difference values and storing the calibrated thermal compensation tables as the initial thermal compensation tables, for the achievement of aging compensation of the light emitting diodes of the respective areas.

12. The driving method as claimed in claim 11, wherein the initial thermal compensation tables are respectively capable of compensating the brightnesses and colors of the areas associated with respective the working temperatures by determining working currents of the light emitting diodes of the areas associated with respective the working temperatures.

13. The driving method as claimed in claim 11, wherein each of the areas comprises at least one electricity-independent sub-area.

14. A driving method of a backlight module, adapted to a display device, the display device comprising a display panel and the backlight module for providing backlighting illumination to the display panel, the backlight module comprising a plurality of light emitting diodes, and further the backlight module comprising a lamp board and a metal backplane, the light emitting diodes being arranged on the lamp board and at the front side of the lamp board, the metal backplane being disposed at the rear side of the lamp board, the optical sensor being mounted to the metal backplane rather than the lamp board, and the lamp board being formed with an opening to expose the optical sensor, the driving method comprising:

only detecting a working temperature of the light emitting diodes, the working temperature being a temperature formed by heat generated from the light emitting diodes;

providing an initial thermal compensation table, obtaining the working temperature and determining working currents of the light emitting diodes corresponding to the working temperature of the light emitting diodes for compensating brightness and color of the backlight module due to a change of the working temperature according to the initial thermal compensation table;

detecting brightness and color of the backlight module at the opening by the optical sensor after a calibration function is enabled, so as to obtain difference values of the detected brightness and color with respect to predetermined brightness and color; and calibrating a content of the initial thermal compensation table corresponding with a current working temperature of the light emitting diodes according to the difference values and storing the calibrated thermal compensation table as the initial thermal compensation table, as a result of aging compensation of the light emitting diodes.

15. The driving method as claimed in claim 14, wherein the initial thermal compensation table is capable of compensating the brightness and color of the backlight module associated with the working temperature by determining working currents of the light emitting diodes associated with the working temperature.

16. The driving method as claimed in claim 14, wherein the working currents of the light emitting diodes are embodied by duty cycles of driving pulses.

17. The driving method as claimed in claim 14, wherein after the calibration function is enabled, the light emitting diodes are fully on.

18. The driving method as claimed in claim 14, wherein the calibration function is enabled before turning off the display device.

19. The driving method as claimed in claim 14, wherein the calibration function is timing enabled.

20. The driving method as claimed in claim 14, wherein the light emitting diodes are arranged in a plurality of electricity-independent areas of the backlight module.

* * * * *